United States Patent [19]

Garner

[11] 4,240,172

[45] Dec. 23, 1980

[54] SHOE UPPER CONFORMING MACHINE

[75] Inventor: Derek H. Garner, Leicester, England

[73] Assignee: USM Corporation, Farmington, Conn.

[21] Appl. No.: 75,743

[22] Filed: Sep. 14, 1979

[30] Foreign Application Priority Data

Sep. 20, 1978 [GB] United Kingdom ..... 37407/78

[51] Int. Cl.[3] ..... A43D 23/00

[52] U.S. Cl. ..... 12/14.5

[58] Field of Search ..... 12/14.5, 8.5, 8.8, 9, 12/10.1, 10.5, 10.8

[56] References Cited

U.S. PATENT DOCUMENTS

| | | | |
|---|---|---|---|
| 3,008,157 | 11/1961 | Weinschenk | 12/14.5 |
| 3,715,767 | 2/1973 | Muhlbach et al. | 12/14.5 |
| 4,155,135 | 5/1979 | Becka | 12/14.5 |

*Primary Examiner*—Patrick D. Lawson

*Attorney, Agent, or Firm*—Donald N. Halgren; Vincent A. White

[57] ABSTRACT

A shoe pulling and lasting machine having an arrangement of side grippers which are each provided with a tensioning device by which an operator can vary the tension in the upper of the shoe being lasted. Each tensioning device is operated through a wedging member, an eccentrically mounted block, which also provides a self-locking facility for the tensioning device.

10 Claims, 3 Drawing Figures

SHOE UPPER CONFORMING MACHINE

BACKGROUND OF THE INVENTION

1. Field of the Invention

This invention relates to shoe machines and more particularly to shoe machines having adjustable tensioning devices therewith.

2. Prior Art

In the manufacture of shoes utilizing conventional shoe lasting machines, shoe uppers have to be pulled snugly over lasts utilizing tensioning devices which have to be held in adjusted position by an operator for the duration of the pulling over operation. This pulling over operation is usually terminated by the marginal portions of the upper being secured to the insole either at selected points or by lasting the marginal portions of the upper with respect to the last. Holding these tensioning devices is a very inconvenient operation for the operator to perform especially when he wishes to vary the tension in one or more localities utilizing one or more grippers on a particular side of the shoe being lasted.

In order to overcome this inconvenience, it has been proposed to provide means for locking the tensioning devices in a particular adjusted position. One such device included a ratchet-and-pawl arrangement. This method is not completely satisfactory because the adjustments must be made stepwise, which is not always smooth and easy, and the release of such an arrangement generally is very complicated.

It is an object of the present invention to provide a shoe lasting machine wherein the action of the tensioning devices is infinitely variable, and wherein such devices can be utilized in a locked-in adjusted position.

BRIEF SUMMARY OF THE INVENTION

The present invention comprises a shoe pulling and lasting machine having an arrangement of grippers each having a tensioning device associated therewith. Each tensioning device has a lever operatively connected with the gripper, and has actuating means for effecting heightwise movement of the lever and the gripper associated therewith, relative to a last support on said machine. Utilization of the tensioning device permits the shoe machine operator to maintain a plurality of tensioned locations in the shoe upper with a plurality of grippers gripped therewith. The actuating means for the tensioning device comprises a wedging member movable in a direction transversely of the heightwise movement of the lever. The actuating means has an inclined abutment surface wherein the wedging member cooperates with a second abutment surface provided on the lever, the inclination of the wedging member and the co-efficient of friction between the abutment member and the second abutment member being such that the application of an upward force to the wedging member, due to a tension in a shoe upper, is insufficient to dislodge the wedging member in a direction transverse of the heightwise movement of the lever.

The curved abutment surface of the wedging member is preferably part-cylindrical, the center of curvature being eccentric to the axis of its support shaft, the arrangement being such that the distance between the center of curvature and its rotational axis is less than UR, where U is the co-efficient of friction between the two abutment surfaces and R is the radius of curvature for the abutment surface.

The second abutment surface provided on the lever of each tensioning device also includes a one-way roller clutch arrangement. Utilization of a roller clutch arrangement permits the co-efficient of friction between the two abutment surfaces to be reduced to insignificant proportions when the wedging member moves in one direction, in which direction the roller clutch arrangement is free to rotate, but the roller clutch arrangement acts as a fixed surface, and the co-efficient of friction is as between two fixed surfaces to hold the wedging member against transverse movement, in an opposite direction. In this way, the variation of the tension under the control of the operator is greatly facilitated by the absence of any significant friction between the surfaces in one direction, while the benefits of the locking action achieved by the friction between the surfaces may be fully utilized when the adjustment has been made.

When the wedging member is in an initial position, the center of curvature of its abutment surface thereof lies vertically above the line of engagement between said surface and the roller clutch arrangement, and further a line passing through said center of curvature and the axis of its support shaft is normal to such vertical. Thus the eccentricity of the center of curvature is at its maximum, when measured in a horizontal plane, when the wedging member is in its initial position. The lever is mounted for pivotal movement under the action of the wedging member in such a manner that the line of engagement between the abutment surfaces varies at substantially the same rate as the eccentricity of the center of curvature. Thus, the line between said line of engagement and said center of curvature remains vertical, or substantially so, as the tension in the upper of the shoe is being varied, as stated above. The lever of each tensioning device is operatively connected to a bar lock arrangement on a support for the gripper associated therewith. Initial movement of the lever is effective to operate the bar lock arrangement, and continued movement is effective to move said bar lock arrangement, and the support, and thus the gripper, therewith.

In operation of the machine, when the securing means are actuated to wipe the marginal portions of the upper against an insole thereadjacent, the grippers are caused to release the marginal portions of the upper and to move further relative to the last support to an out-of-the-way position, such movement also being effective to release the wedging member of each tensioning device. This release is achieved by moving the bar lock arrangement downwardly together with the gripper on its support, thereby allowing the lever of the tensioning device to move downwardly also, tending thereby to move the two abutment surfaces apart. Furthermore, upon release of the wedging member, the bar lock arrangement is released by the lever, which no longer applies a downward force thereto under the action of the wedging member, spring means preferably being provided to urge said bar lock arrangement into a non-locking condition on the support for the gripper. At the end of the operating cycle, regardless of the position to which the tensioning device was moved by the operator, the device is released and returned to its initial condition in readiness for the next operating cycle without any requirement for the operator to reset the tensioning devices.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
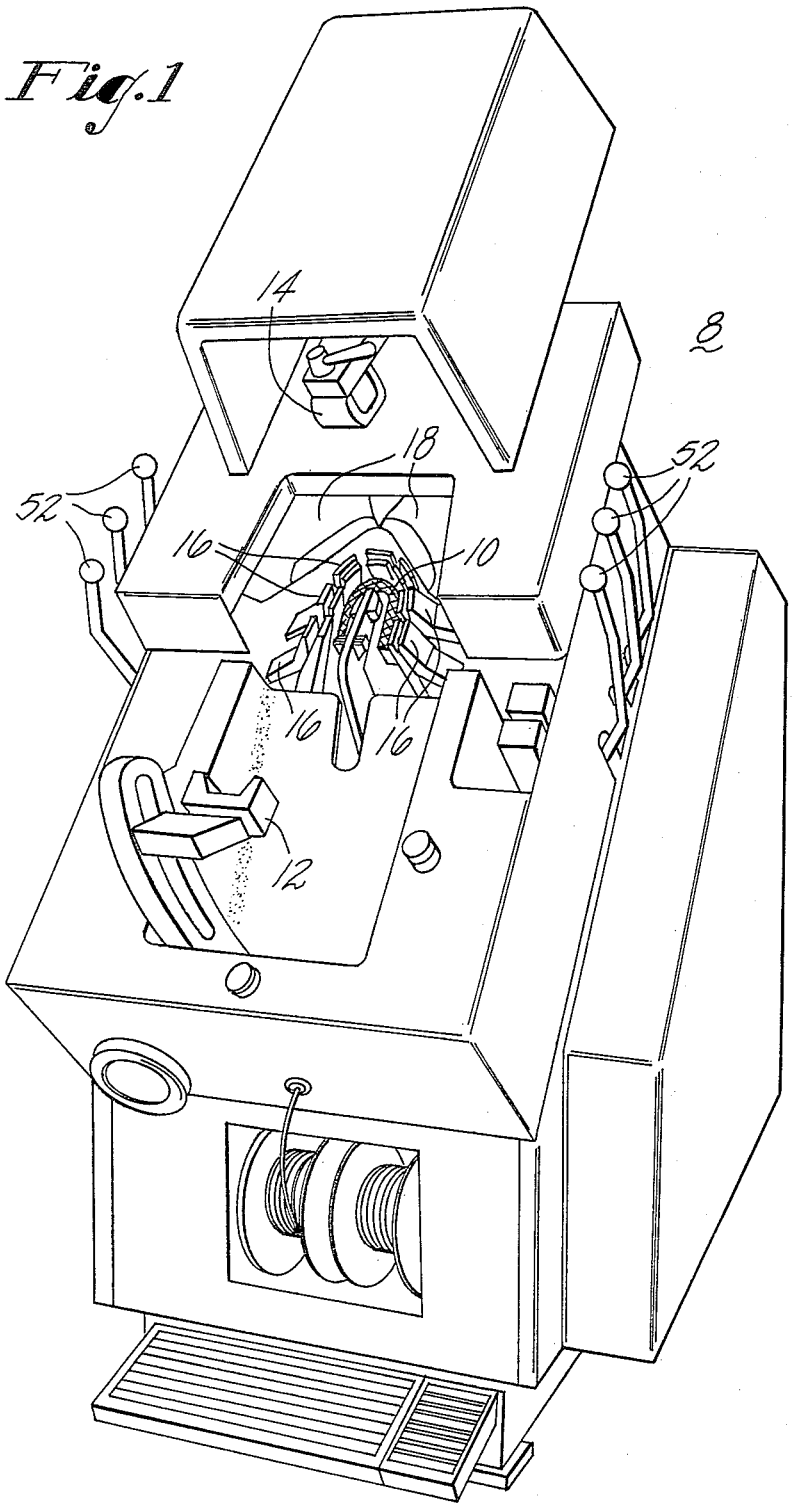
FIG. 1 is a perspective view of a shoe pulling and lasting machine showing a plurality of grippers and hand levers associated therewith.
Figure 2:
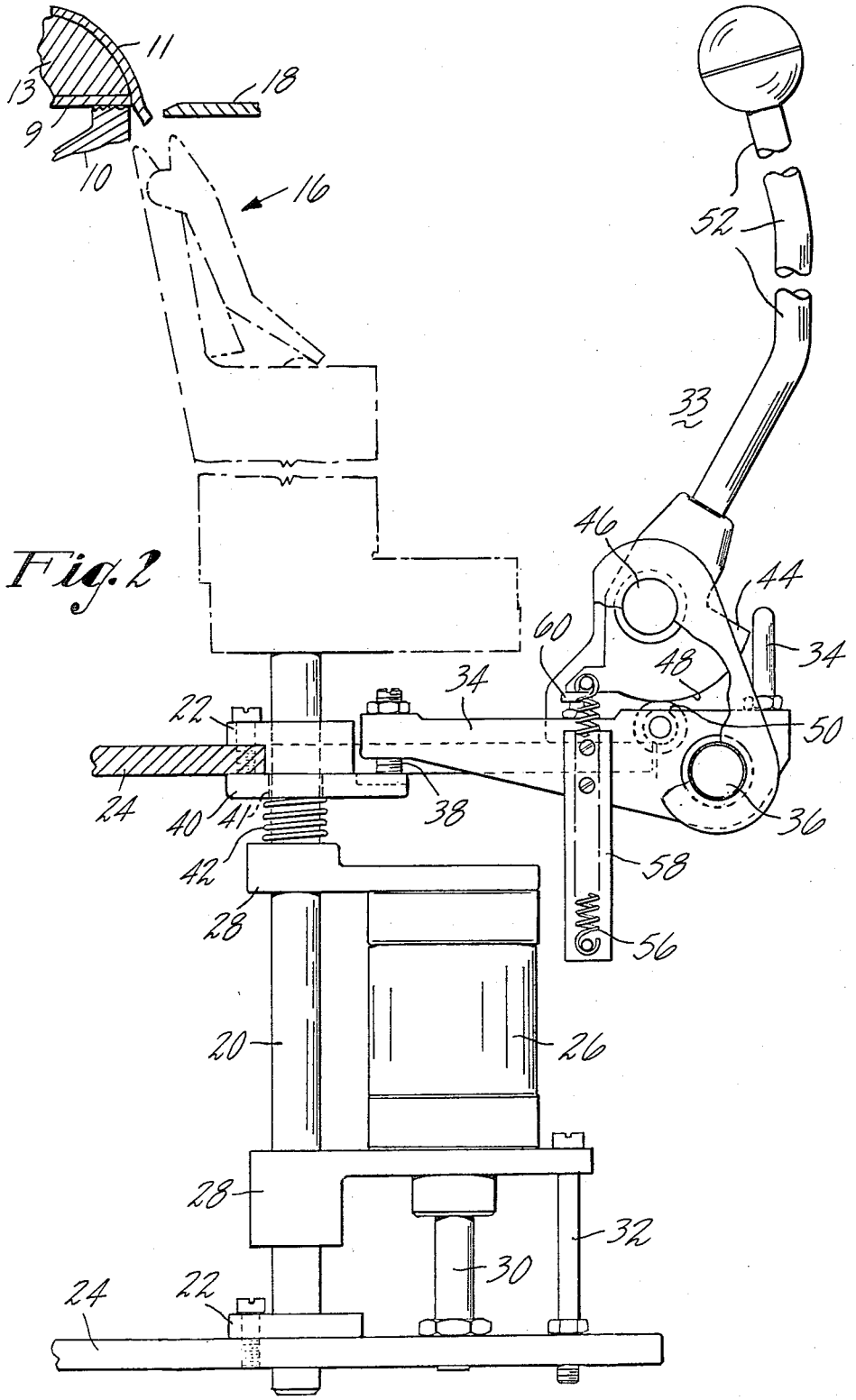
FIG. 2 is a fragmentary view showing one gripper and its associated tensioning device.

Referring now to the drawings in detail, and particularly to FIGS. 1 and 2, there is shown a shoe pulling and lasting machine 8, the shoe pulling and lasting machine including a last support 10, which also serves to apply a pattern of cement to marginal portions of an insole 9 supported thereon, shown only in FIG. 2, prior to the toe lasting operation. The pulling and lasting machine 8, also comprises a heel rest 12, a toe pad 14, a plurality of grippers 16, in this case seven, and means in the form of a pair of wiper plates 18 for securing the marginal portions of an upper 11, to the insole 9, to be secured to a last bottom 13 in the lasting operation.

The grippers 16, are generally arranged in a U-shaped pattern about the last support 10, the arrangement comprising a central toe gripper and two sets each of three side grippers. One of the side grippers 16 and its associated mechanism, is shown in FIG. 2 with a partial view of the upper 11 and insole 9 on the last 13. The gripper 16 is mounted on a support rod 20 which is slidable heightwise in an arrangement of bearings 22 supported by both an upper and lower frame portion 24 of the shoe machine 8. A pneumatic motor comprising a cylinder 26 effects heightwise movement of the gripper 16. The cylinder 26 is secured to the support rod 20 by a pair of upper and lower clamp brackets 28. The cylinder 26 accommodates a piston, not shown, having a piston rod 30 which is screwed into the lower frame portion 24 of the machine 8. Admission of a fluid under pressure to the pneumatic motor is effective to move the cylinder 26, and thus the support rod 20, heightwise with respect to the machine 8. The lower clamp bracket 28 limits the heightwise movement capablities of the pneumatic motor because the clamp bracket 28 is extended and has an aperture which accommodates a headed guide bolt 32 screwed into the lower frame portion 24 of the machine 8. The guide bolt 32 is adjustable heightwise.

Each gripper 16, as shown in FIG. 2, has a tensioning device 33, which can be controlled by a machine operator. Each tensioning device 33 comprises a lever 34 pivotally mounted on a cross shaft 36. The cross shaft 36 carries the respective levers associated with each of the three side grippers of a set. Each lever 34, carries an adjustment screw 38 at its distal end. The adjustment screw 38 abuts against a plate 40 carried on the support rod 20. The interaction of the adjustment screw 38 and the plate 40 comprise a bar lock arrangement. The support rod 20 extends through an oversized aperture 41 in the plate 40. A spring 42 disposed around the support rod 20, serves to urge the plate 40 against the upper bearing 22. The plate 40 is in a non-locking, that is, a non-binding condition when it is disposed horizontally, but it is in a locking condition when the plate 40 is first depressed by movement of the lever 34 so that the edges of the aperture 41 grip onto the surface of the support rod 20. A wedging member 44, effective for actuating the lever 34, is mounted for pivotal movement on a cross shaft 46. The cross shaft 46 also carries the respective wedging members for each tensioning device of each of the grippers. The wedging member 44 is in the form of a cam having a curved abutment surface, the center of curvature thereof being eccentric to the axis of the support shaft 46, so that rotation of the wedging member is effective to move the abutment surface 48 thereof downwardly.

The lever 34 is provided with a co-pending abutment surface, provided by a one-way roller clutch arrangement 50. A roller clutch arrangement, permits movement of the wedging member 44, clockwise as shown in FIG. 2, to urge the lever 34 downwardly, counterclockwise as shown in FIG. 2, which movement is not resisted, because of the rolling action of the clutch. Any tendency for the wedging member to move in an opposite direction, counterclockwise as shown in FIG. 2, is resisted by the friction between the two abutment surfaces 48 and 50. A hand lever 52 is provided on the shaft 46 for effecting the rotation of the wedging member 44. A stop member 54 on the lever 52 determines the maximum swing of the hand lever 52.

To ensure that the tensioning device 33 is self locking, the difference between the center of curvature of the curved abutment surface 48 and the axis of the shaft 46 is less than the letter UR, where the letter U is the coefficient of friction between the two abutment surfaces and R is the radius of the curved abutment surface. Thus, the application of an upward force to the wedging member 44 through the roller clutch arrangement 50 as a result of the tension in a shoe upper is insufficient to dislodge the wedging member 44 in a direction transversely of the heightwise movement of the lever 34.

Figure 3:
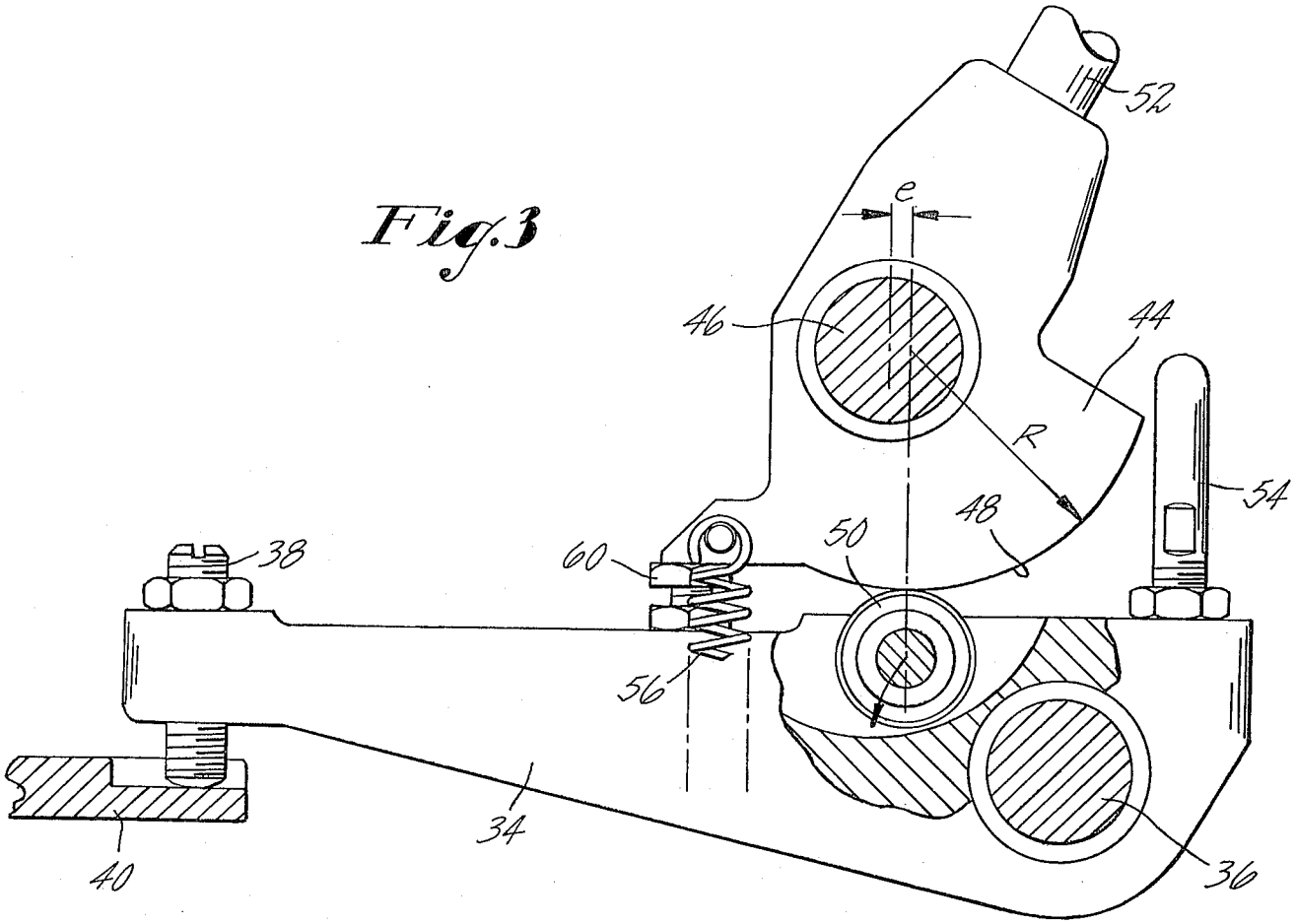
FIG. 3 is a fragmentary view, on an enlarged scale of an eccentric arrangement of the tensioning device for locking said device in adjusted condition.

The geometric relationship of the parts of the tensioning device 33 is more clearly shown in FIG. 3. The letter e represents the eccentricity, measured in a horizontal plane. The wedging member 44 is shown in an initial position in FIG. 3. The center of curvature of the abutement surface 48 lies vertically above the line of engagement between said surface and the roller clutch arrangement 50. Additionally, a line passing through the center of curvature and the axis of the support shaft 46 is normal to such vertical. Furthermore, since the lever 34 is mounted for pivotal movement about the shaft 36 as the wedging member 44 is rotated clockwise, as shown in FIG. 3, the eccentricity, measured in a horizontal plane, decreases at substantially the same rate as the line of engagement between the surface and the roller clutch arrangement 50 which moves to the left, as shown in FIG. 3, as a result of the pivotal movement of the lever 34. Thus, in the operation of the tensioning device 33, the upward force applied to the wedging member 44 as a result of the tension in a shoe upper tends always to be applied through or substantially through the center of curvature of the abutment surface 48.

In the cycle of operation of the shoe pulling and lasting machine 8, the grippers 16 are caused to grip marginal portions of the shoe upper 11 carried on the last 13 supported by the last support 10, and thereafter the pneumatic cylinders 26 are actuated to cause the upper to be tensioned over the last. At this stage of the operational cycle of the machine 8, if the machine operator is not entirely satisfied with the position of the upper or with the tensions therein, he can selectively vary the tensions by use of the plurality of tensioning devices through the hand levers 52. The arrangement of each respective wedging member 44 permits it to remain locked in its adjusted position. The action of the tensioning device 33 is to cause the lever 34 to pivot downwardly, thereby locking the bar lock arrangement comprising the plate 40, including the aperture 41 which is disposed grippingly about the support rod 20. Continued counterclockwise motion of the lever 34 causes the urging the support shaft 20 together with the cylinder 26 and also the gripper 16, downwards under the control of the lever 52. When the machine operator is satisfied with the position of the shoe upper, the operation of the shoe machine is continued, whereupon wiper means 18, constituting means for securing the marginal portions of the upper to an insole secured to the last bottom, take over the tensioned shoe upper from the grippers 16. The grippers 16 are caused to release the marginal portions of the shoe upper and move further downwardly under the action of the pnuematic cylinders 26 to an out-of-the-way position. This additional downward movement is effective to release the bar lock arrangement comprising the aperture 41 in the plate 40, through which extends the rod 20 the plate 40 then being returned by its spring 42 to a non-locking or horizontal condition. At the same time, the pressure applied through the bar lock arrangement 40 to the lever 34, and thus to the wedging member 44, is released, whereupon a spring 56, acting between a bracket 58 on the lever 34, and a lug on the wedging member 44, is effective to return the wedging member 44 to its initial position, which in turn determines the uppermost position of the lever 34, to which the lever 34 is then also returned. The initial position of the wedging member 44 and the uppermost position of the lever 34 is determined by a stop member 60 carried on the lever 34 and abuting the lug on the wedging member 44.

Thus there has been shown a locking device which permits the securing of grippers to provide a predetermined tension in shoe uppers during the course of shoe manufacture. The following appended claims are to interpreted as exemplary only and not in a limiting sense.

I claim:

1. A shoe manufacturing machine comprising:

a last support with a last, a shoe upper, and an insole supported thereon;

a plurality of grippers arranged about the last support for gripping marginal portions of said shoe upper;

means for effecting relative heightwise movement between the last support and the grippers to cause said upper to be tensioned over said last;

an operator-controlled tensioning device associated with each gripper for varying at the discretion of the operator the tension in said shoe upper applied in the locality of said gripper, wherein said tensioning device comprises a lever operatively connected with said gripper associated with the device;

actuating means for effecting heightwise movement of said lever and said gripper relative to said last support, to vary the tension in said shoe upper, wherein said actuating means comprises a wedging member movable in a direction transversely of the heightwise movement of said lever and having an inclined abutment surface, said member co-operating with a further abutment surface provided on the lever, the inclination of the wedging member and the co-efficient of friction between said member and said further abutment surface being such that the application of an upward force to the wedging member as a result of the tension in said shoe upper is insufficient to dislodge said wedging member in a direction transversely of the heightwise movement of said lever.

2. A shoe manufacturing machine as recited in claim 1 wherein said wedging member of each tensioning device is in the form of a cam having a curved abutment surface, said cam being mounted for rotation on a support shaft extending normal to the transverse direction of movement of the abutment surface of said wedging member, the arrangement being such that said surface co-operates with the further abutment surface provided on said lever.

3. A shoe manufacturing machine as recited in claim 2 wherein the curved abutment surface of said wedging member of each tensioning device is part-cylindrical, the center of curvature thereof being eccentric to the axis of said support shaft, the arrangement being such that the distance between said center of curvature and said axis is less than UR, where U is the co-efficient of friction between the two abutment surfaces and R the radius of said curved abutment surface.

4. A shoe manufacturing machine as recited in claim 2 wherein a hand lever is mounted on said support shaft for effecting rotation of said wedging member thereon.

5. A shoe manufacturing machine as recited in claim 2 wherein said further abutment surface provided on the lever of each tensioning device is provided by a one-way roller clutch arrangement.

6. A shoe manufacturing machine as recited in claim 5 wherein said wedging member in an initial position, is arranged so that the center of curvature of said abutment surface thereof lies vertically above the line of engagement between said surface and said roller clutch arrangement, and further wherein a line passing through said center of curvature and the axis of said support shaft is normal to such vertical.

7. A shoe manufacturing machine as recited in claim 5 wherein said lever is mounted for pivotal movement under the action of said wedging member.

8. A shoe manufacturing machine as recited in claim 5 wherein said lever of each tensioning device is operatively connected to a bar lock arrangement on a support for said gripper, initial movement of said lever being effective to operate said bar lock arrangement and continued movement being effective to move said bar lock arrangement, and its support, and thus said gripper, therewith.

9. A shoe manufacturing machine as recited in claim 8 wherein means is provided for securing marginal portions of said upper to an insole secured to the last bottom, wherein said means for effecting relative movement between said last support and said grippers comprises a fluid pressure operated motor, the arrangement being such that, when said securing means is actuated to secure said upper marginal portions against said insole, said grippers being caused to release said upper marginal portions and to move further relative to said last support to an out-of-the-way position, such movement being also effective to release said wedging member of each device.

10. A shoe manufacturing machine as recited in claim 9 wherein release of said wedging member permits release of said bar lock arrangement by said lever, a spring means being provided for urging said bar lock arrangement into a non-locking condition.

* * * * *